United States Patent [19]

Wells et al.

[11] Patent Number: 4,908,596

[45] Date of Patent: Mar. 13, 1990

[54] THERMOSTAT ASSEMBLY

[75] Inventors: Gordon K. Wells; Bradley D. Funk, both of Mansfield, Ohio

[73] Assignee: Therm-O-Disc, Incorporated, Mansfield, Ohio

[21] Appl. No.: 311,811

[22] Filed: Feb. 17, 1989

[51] Int. Cl.[4] ..... H01H 37/52

[52] U.S. Cl. ..... 337/354; 337/372; 337/380

[58] Field of Search ..... 337/372, 380, 354, 342, 337/343, 388, 52; 267/159

[56] References Cited

U.S. PATENT DOCUMENTS 3,602,863 8/1971 Place ..... 337/354

4,365,225 12/1982 Olsen et al. ..... 337/354

*Primary Examiner*—H. Broome

*Attorney, Agent, or Firm*—Jones, Day, Reavis & Pogue

[57] ABSTRACT

A thermostat assembly includes a spring washer interposed between a switch case and a bimetal disc for biasing such disc into firm engagement with the disc housing to enhance heat transfer and dampen bouncing of the disc.

17 Claims, 5 Drawing Sheets

THERMOSTAT ASSEMBLY

BACKGROUND OF THE INVENTION

This application relates to the art of thermostats and, more particularly, to thermostats of the type that use a bimetal disc operative in response to temperature changes for opening and closing switch. Although the invention is particularly applicable to thermostat assemblies, it will be appreciated that the improved spring washer of the present application can also be used in other environments.

Thermostat assemblies of a known type include a bimetal disc positioned between a switch case and a metal disc housing. Heat is transferred to and from the bimetal disc through the metal disc housing. Poor heat transfer takes place if the bimetal disc is not in firm engagement with its metal housing under all operating conditions. It would be desirable to have a simplified arrangement for maintaining the bimetal disc in firm engagement with its metal housing to provide enhanced heat transfer.

SUMMARY OF THE INVENTION

A thermostat assembly of the type described includes biasing means interposed between a switch case and a bimetal disc for biasing such disc into firm engagement with its metal housing.

In one arrangement, the biasing means is in the form of a spring washer having a flat ring-like base portion. Resilient attaching means is provided on the spring washer for attaching same to a switch case. In a preferred arrangement, the resilient attaching means comprise a pair of opposite spring fingers extending generally perpendicular from the base portion of the spring washer adjacent the inner periphery thereof.

Locating means is provided on the spring washer for locating and maintaining a predetermined relationship between the spring washer and the bimetal disc during assembly. The locating means may be in the form of a plurality of circumferentially-spaced locating tabs having first tab portions extending outwardly from the outer periphery of the base portion, and second tab portions extending generally perpendicular to the first tab portions.

Disc biasing means for biasing against the bimetal disc includes a plurality of circumferentially-spaced disc biasing tabs extending outwardly from the outer periphery of the base portion and being bent downwardly from the base portion at angles of less than 30°.

Opposite biasing means is provided on the spring washer for biasing against an end surface on the switch case in opposition to the disc biasing means. The opposite biasing means may comprise a set of biasing tabs complementary to the disc biasing means.

The disc biasing means preferably engages the bimetal disc only adjacent the outer peripheral portion thereof.

It is a principal object of the present invention to provide an improved thermostat assembly having a bimetal disc biased into firm engagement with its metal housing.

It is a further object of the invention to provide an improved spring washer for biasing a bimetal disc into engagement with its metal housing.

It is an additional object of the invention to provide such a thermostat and a spring washer that is economical to manufacture and assemble.

DESCRIPTION OF A PREFERRED EMBODIMENT

Figure 1:
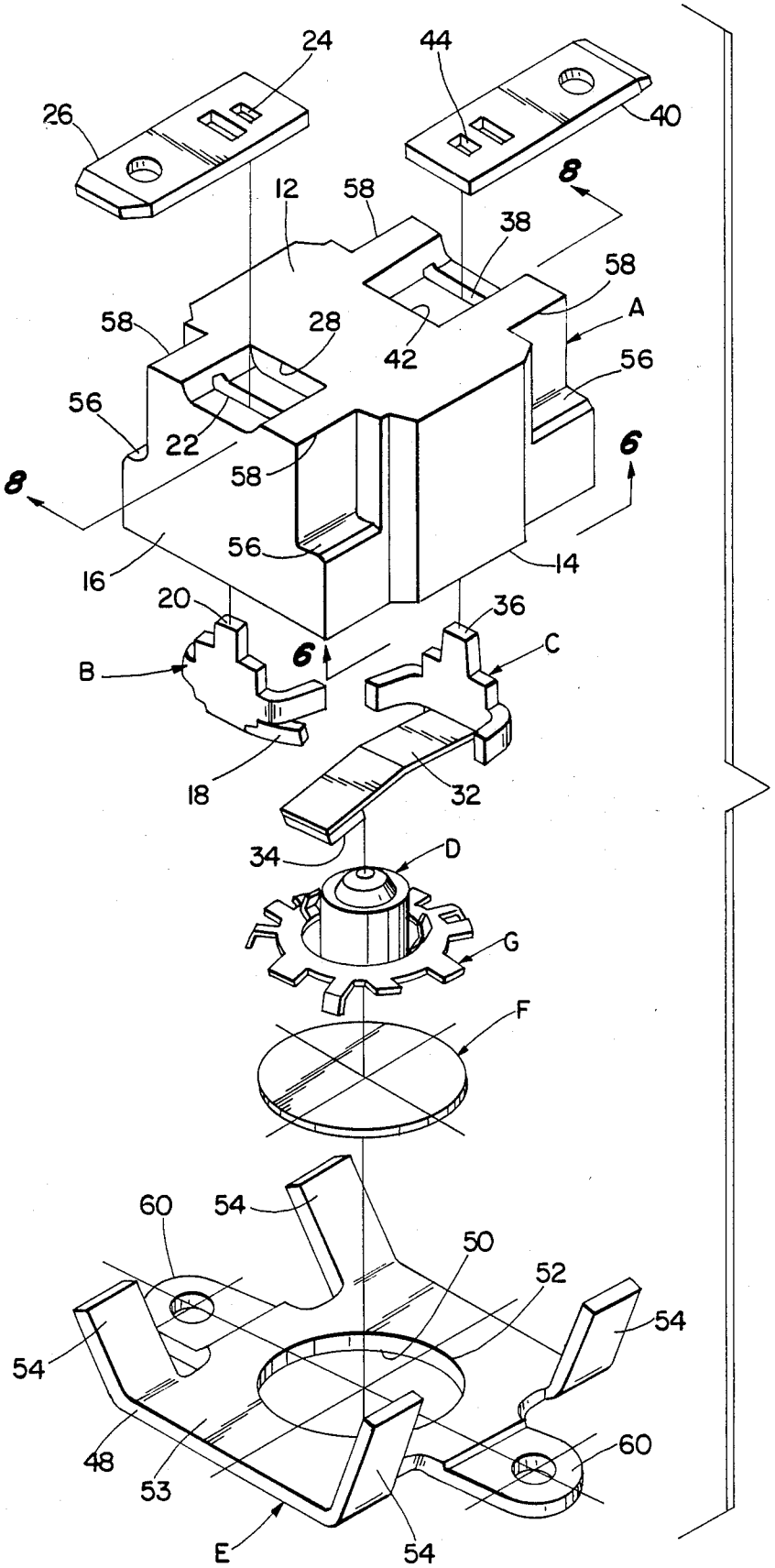
FIG. 1 is an exploded perspective illustration of a thermostat assembly.
Figure 2:
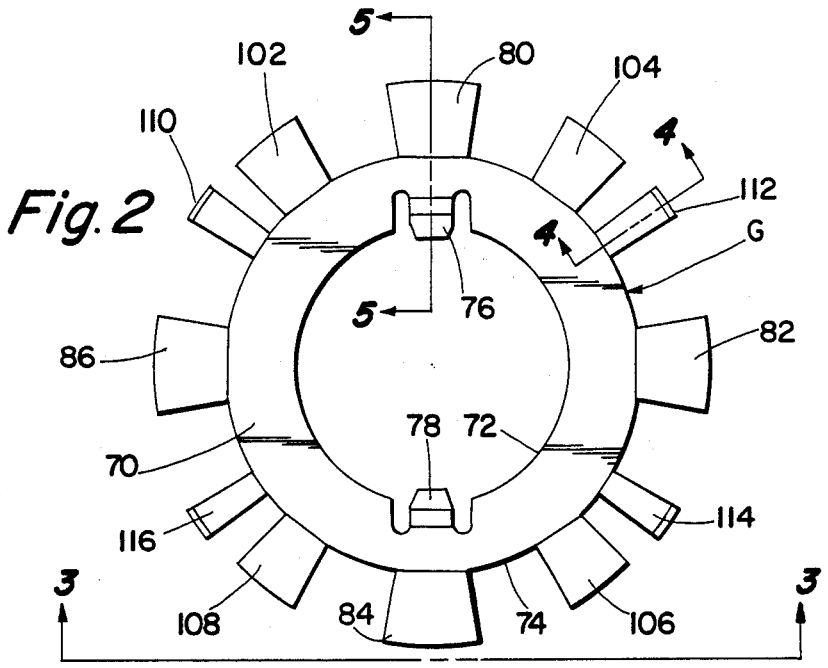
FIG. 2 is a top plan view of a spring washer constructed in accordance with the present application.
Figure 3:
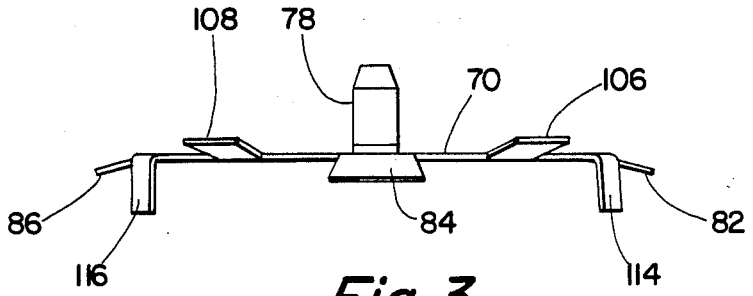
FIG. 3 is an end elevational view taken generally on line 3—3 of FIG. 2.

Referring now to the drawing, wherein the showings are for purposes of illustrating a preferred embodiment of the invention only and not for purposes of limiting same, FIG. 1 shows a ceramic switch case A having a closed end 12 and an open end 14 providing access to a hollow interior. A peripheral wall 16 extends between closed end 12 and open end 14.

A stationary contact support B has an electrical contact 18 mounted thereon. Stationary contact support B is receivable within the hollow interior of switch case A, and a projection 20 thereon is extendable through a slot 22 in closed end 12. Projection 20 is receivable in a hole 24 in a terminal 26 that is receivable in a recess 28 in closed end 12 aligned with slot 22. Projection 20 is then spun over to fasten stationary contact support B with terminal 26.

Movable contact support C is receivable within the hollow interior of switch case A, and has an elongated movable switch arm 32 welded and crimped thereto. A movable contact 34 is carried by the free end portion of movable switch arm 32. Movable contact support C has a projection 36 thereon extendable through a slot 38 in closed end 12. A terminal 40 is receivable in a recess 42 in closed end 12 aligned with slot 38. A hole 44 in terminal 40 receives projection 36 on movable contact support C. Projection 36 is then spun over for fastening terminal 40 with support C.

A transfer pin D is positioned and guided within the hollow interior of switch case A for longitudinal movement, and cooperates with switch arm 32 for moving movable contact 34 into and out of engagement with stationary contact 18.

An aluminum housing E has a central circular recess 50 therein surrounded by a shoulder 52. A plurality of bendable securing tabs 54 on housing E are formable into firm engagement with shoulders 56 provided by corner recesses 58 on switch case A. Aluminum housing E thereby closes open end 14 of switch case A. Bimetal disc F spans recess 50 in housing E, and a peripheral surface portion of disc F engages shoulder 52. Mounting tabs 60 are provided on housing E for mounting the assembled thermostat.

A spring washer G constructed in accordance with the present application biases against an end surface on switch casing A and against bimetal disc F for maintaining same in firm engagement with shoulder 52 on housing E. The biasing action takes place in both of the oppositely bowed positions of bimetal disc F, as well as positions therebetween, and enhances heat transfer between the disc and housing. Spring washer G also provides damping action to reduce bouncing of bimetal disc F when it snaps between its opposite positions.

Bimetal disc F is normally bowed downwardly into recess 50 in housing E, and electrical contacts 18, 34 are closed. When bimetal disc F reaches a predetermined temperature, it snaps to a reversed curvature and moves transfer pin D longitudinally to bend switch arm 32 and separate movable contact 34 from stationary contact 18.

FIGS. 2–5 show spring washer G as including a flat ring-like base portion 70 having inner and outer peripheries 72, 74. Inner periphery 72 defines a central hole in spring washer G through which transfer pin D freely moves.

Resilient attaching means is provided for attaching spring washer G to switch case A. In the arrangement shown, the resilient attaching means is in the form of a pair of opposite resilient spring fingers 76, 78 located adjacent inner periphery 72.

Figure 5:
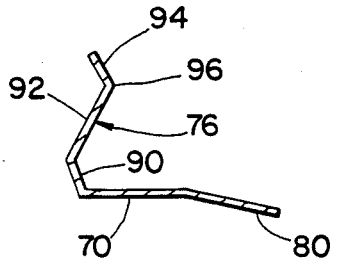
FIG. 5 is a partial cross-sectional elevational view taken generally on line 5—5 of FIG. 2.

Disc biasing means is provided on spring washer G for biasing bimetal disc F into firm engagement with shoulder 52 on housing E. In the arrangement shown, the disc biasing means is in the form of four disc biasing tabs 80, 82, 84 and 86 circumferentially-spaced around base portion 70. As shown in FIG. 5, each disc biasing tab is bent downwardly relative to flat base portion 70 at an angle less than 30°, and preferably around 15°. The outer curved ends of disc biasing tabs 80–86 lie on the periphery of a circle having a diameter that is approximately same as the diameter of bimetal disc F.

FIG. 5 also shows a finger 76 as having a first short portion 90 inclined upwardly from flat base portion 70 at an angle of about 60°, a second elongated portion 92 extending at an angle of about 60° to first portion 90, and a third or terminal portion 94 extending at an angle of about 60° to second portion 92. The intersection 96 of the second and third portions 92, 94 defines an engaging portion that grippingly engages the bottom surface of a recess in switch case A.

Opposite biasing means is provided on spring washer G for biasing against an end surface on switch case A in opposition to disc biasing tabs 80–86. The opposite biasing means is in the form of four opposite biasing tabs 102, 104, 106 and 108 circumferentially-spaced around flat base portion 70. Opposite biasing tabs 102–108 are bent upwardly from flat base portion 70 at angles less than 30 and preferably about 15°.

Locating means is provided for locating and maintaining a predetermined relationship between spring washer G and bimetal disc F during assembly of same into the thermostat housing. The locating means is in the form of four resilient locating tabs 110, 112, 114 and 116 circumferentially-spaced around flat base portion 70.

Figure 4:
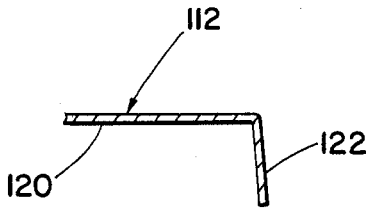
FIG. 4 is a partial cross-sectional elevational view taken generally of line 4—4 of FIG. 2.

As shown in FIG. 4, each locating tab includes a first elongated portion 120 extending outwardly from base portion 70 in the same plane therewith and a second portion 122 extending substantially perpendicular to first portion 120. The included angle between first and second portions 120, 122 is preferably slightly greater than 90° to allow for springback. Axially of spring washer G, the terminal ends of second portions 122 are spaced substantially further from flat base portion 70 than the terminal ends of disc biasing tabs 80–86. The terminal ends of second portions 122 on the locating means preferably lie on the periphery of a circle having a diameter slightly greater than the diameter of the circle on which the ends of tabs 80–86 and 102–108 lie.

The circumferential width of locating tabs 110–116 is substantially less than the circumferential width of biasing tabs 80–86 and 102–108 so that the locating tabs are readily bendable out of the way when housing E is assembled to case A.

Figure 6:
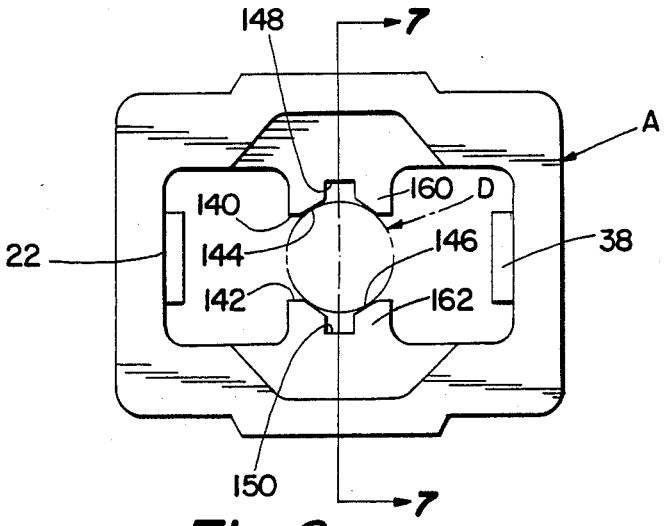
FIG. 6 is a bottom plan view looking into a switch case in the general direction of arrows 6—6 of FIG. 1.
Figure 7:
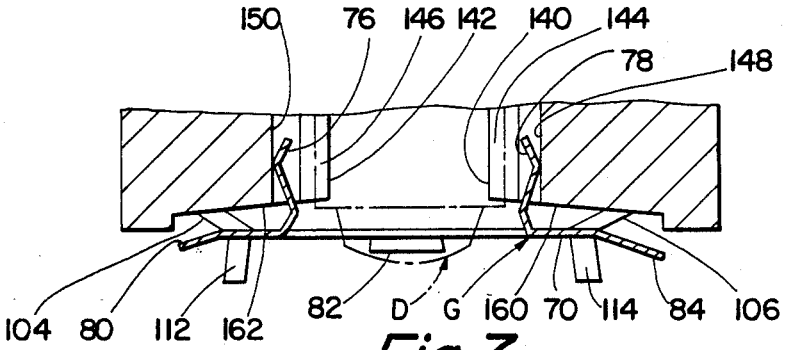
FIG. 7 is an inverted partial cross-sectional elevational view taken generally on line 7—7 of FIG. 6.

FIG. 6 shows the interior of switch case A as having opposite spaced-apart bosses 140–142 with opposed generally U-shaped transfer pin guideways 144, 146 in which transfer pin D is guided for longitudinal reciprocal movement. Elongated rectangular recesses 148, 150 at the base of the guideways extend longitudinally of transfer pin D for receiving resilient spring fingers 76, 78 on spring washer G as shown in FIG. 7. Recessed cavities 160, 162 in bosses 140, 142 are provided for receiving at least portions of biasinq tabs 102–108 on sprinq washer G. The flat bottom surfaces of cavities 160, 162 are engaged by opposite biasing tabs 102–108 as shown in FIG. 7.

Figure 8:
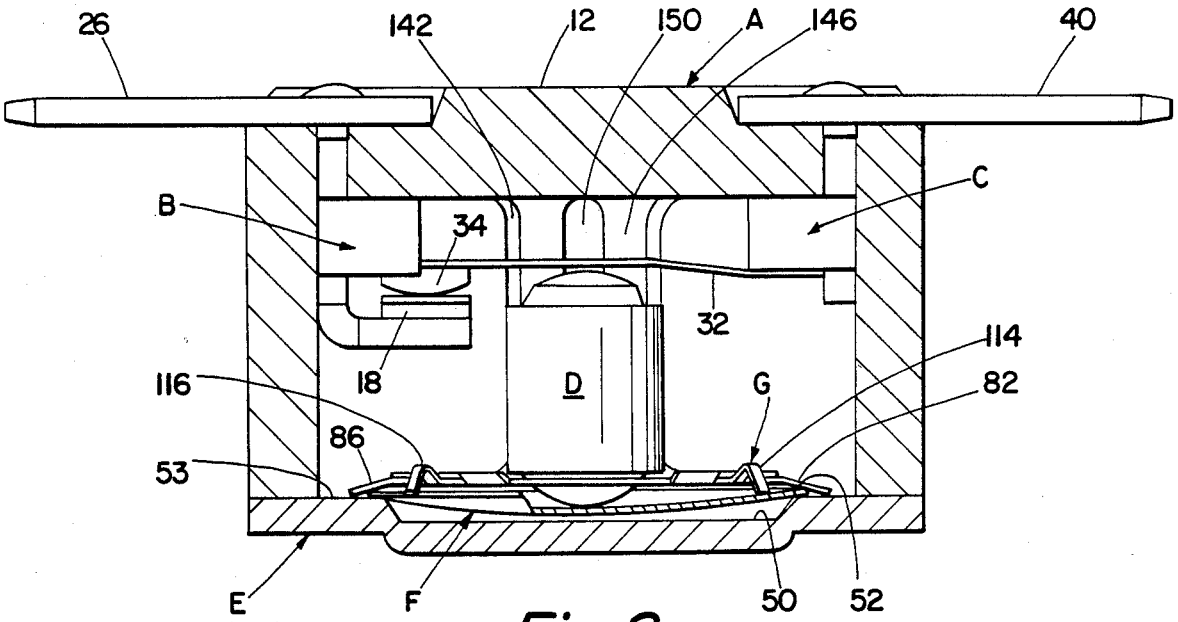
FIG. 8 is a partial cross-sectional elevational view taken generally on line 8—8 of FIG. 1, and with portions removed for clarity of illustration.

When spring washer G, bimetal disc F and housing E are assembled, switch case A is inverted from the position shown in FIG. 8. With the case so inverted, spring washer G can be attached to the bosses within the hollow interior of switch case A. Bimetal disc F is then placed within the locating tabs which are on a slightly greater diameter circle than the diameter of the bimetal disc. Thus, bimetal disc F is freely received within the locating tabs but is located and maintained in a predetermined relationship relative to spring washer G while housing E is attached to switch case A. When housing E is attached, flat surface 53 adjacent shoulder 52 engages the terminal ends of the locating tabs to push same upwardly out of the way. The axial clearance between disc housing E and the bottom of switch case A is sufficient to allow such displacement.

The outer terminal ends of the disc biasing tabs engage bimetal disc F closely adjacent the outer periphery thereof for firmly biasing same into engagement with shoulder 52. Regardless of whether the thermostat assembly is mounted in the position shown in FIG. 8, in an inverted position, or in positions therebetween, spring washer G will always firmly bias the bimetal disc into engagement with its aluminum housing E to provide enhanced heat transfer.

When bimetal disc F snaps to a reversed curvature from that shown in FIG. 8, transfer pin D moves upwardly into engagement with switch arm 32 for moving movable contact 34 out of engagement with stationary contact 18. In the reversed curvature position of bimetal disc F, the disc biasing means is still operative to maintain firm engagement of the disc with aluminum housing E. When the bimetal disc cools, it snaps back to the position shown in FIG. 8 for allowing transfer pin D to move longitudinally toward housing E and allow the switch contacts to close. In the reversed curvature position of bimetal disc F, the biasing force of switch arm 32 acting through transfer pin D also biases bimetal disc F into firm engagement with its housing E.

The attaching means defined by resilient spring fingers 76, 78 also defines a locating means for locating spring washer G centrally of the switch case during assembly of housing E thereto. With bimetal disc F held within locating tabs 110–116, both spring washer G and bimetal disc F are located on switch case A in substantially centered axial alignment with the center of recess 50 in housing E and with the longitudinal axis of transfer pin D.

Figure 9:
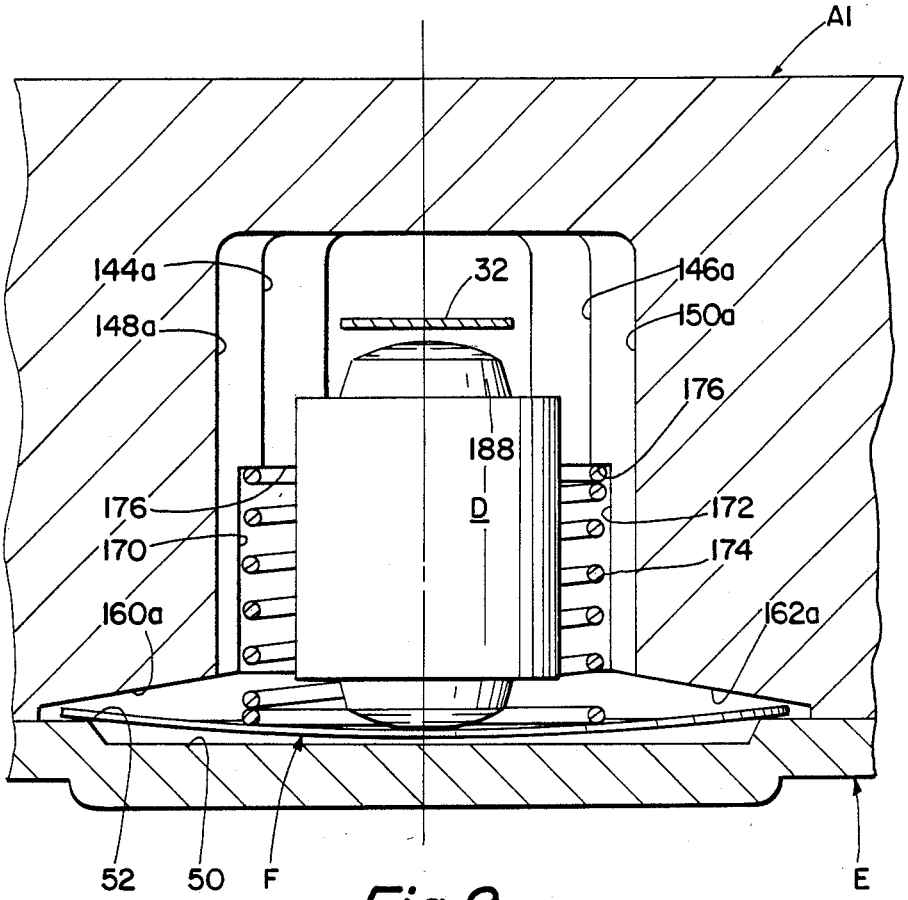
FIG. 9 is a partial cross-sectional elevational view of another and less preferred embodiment.

FIG. 9 shows switch case Al having guide surfaces 144*a*, 146*a* for transfer pin D. Guide surfaces 144*a*, 146*a* are cut-away to provide a coil spring receiving cavity having surfaces 170, 172 that lie on the periphery of a common cylinder having a longitudinal axis coincidental with transfer pin D. A coil spring 174 is received in the cavity in outwardly-spaced relationship to transfer pin D. One end of spring 174 bears against shoulders 176, 178 in switch case Al, and the opposite end bears against bimetal disc F for firmly biasing same into engagement with its housing E. Cavities 160*a*, 162*a* are provided in the bottom of switch case Al to accommodate reverse bending of bimetal disc F.

Figure 10:
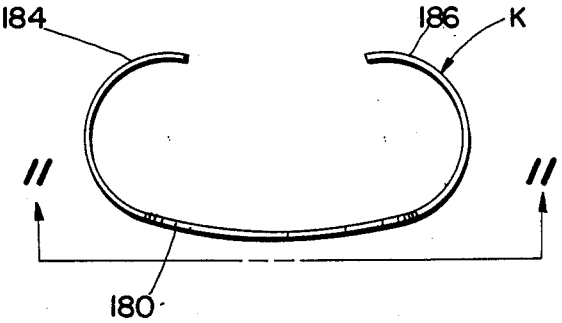
FIG. 10 is a side elevational view of a biasing spring used in another less preferred embodiment.
Figure 11:
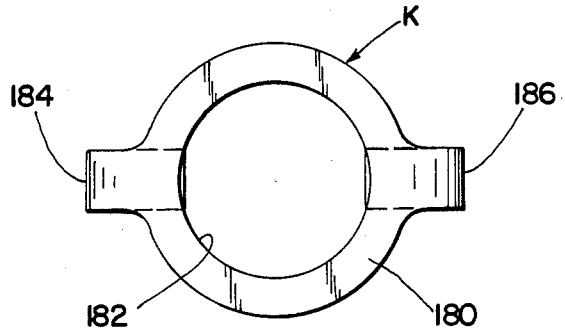
FIG. 11 is a bottom plan view taken generally on line 11—11 of FIG. 10.

FIGS. 10 and 11 shoW leaf spring K having an annular base portion 180 with a central hole 182 therein. Opposite reversely curved spring arms 184, 186 extend outwardly and upwardly from base portion 180.

Figure 12:
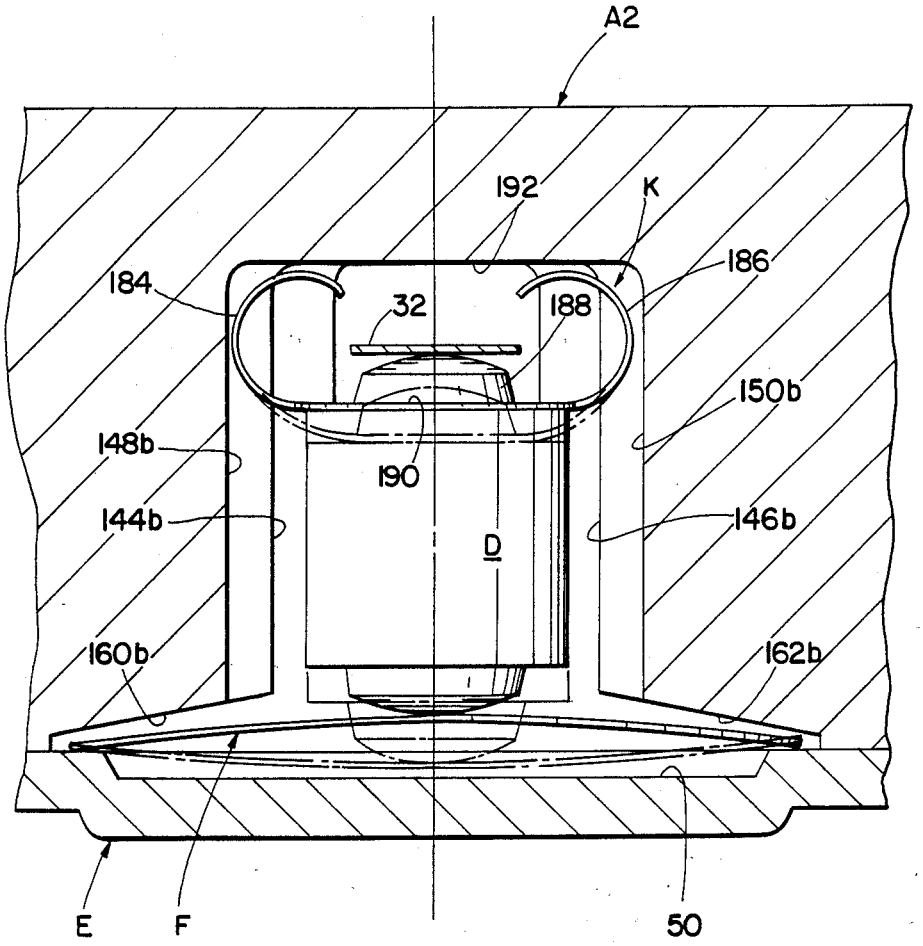
FIG. 12 is a partial cross-sectional view showing the less preferred embodiment using the spring of FIGS. 10 and 11.

FIG. 12 shows switch case A2 having transfer pin D with reduced diameter rounded nose portion 188 that is closely received through hole 182 in base portion 180 of leaf spring K. Base portion 180 bears against a shoulder 190 on transfer pin D. Spring arms 184, 186 bear against an end surface 192 in switch case A2. Cavities 160*b*, 162*b* are provided in switch case A2 to accommodate the reverse bowing of bimetal disc F. Spring K, acting through transfer pin D, biases bimetal disc F into firm engagement with its housing E.

As previously mentioned, the outer ends of disc biasing tabs 80–86 and the outer periphery of bimetal disc F lie approximately on the circumference of a common circle. When tabs 80–86 are flexed during assembly of the thermostat, the ends of such tabs will lie on the circumference of a circle having a diameter slightly greater than the diameter of the circle on which the periphery of disc F lies. Tabs 80–86 will then engage the edge intersection between the periphery of disc F and the surface of disc F that faces toward transfer pin D. In any event, tabs 80–86 preferably engage disc F at or closely adjacent the aforementioned edge intersection.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A spring washer for assembly between a switch case and a bimetal disc in a thermostat to bias the disc in a direction away from the switch case, said spring washer having resilient attaching means for attaching same to a switch case, locating means on the opposite side of said spring washer from said attaching means for locating and maintaining the position of a bimetal disc relative to said spring washer during assembly of same into a thermostat housing, and disc biasing means on the same side of said spring washer as said locating means for engaging and biasing a bimetal disc in a direction away from said spring washer.

2. The spring washer of claim 1 wherein said locating means is positioned for cooperation with the outer periphery of a bimetal disc and said disc biasing means is positioned for engaging and biasing a surface of such disc closely adjacent its outer periphery.

3. The spring washer of claim 11 wherein said spring washer includes a flat ring-like base portion having inner and outer peripheries, said attaching means extending from said base portion adjacent said inner periphery, and said locating means and said disc biasing means extending from said base portion adjacent said outer periphery.

4. The spring washer of claim 1 wherein said locating means comprises a plurality of circumferentiallyspaced locating tabs and said disc biasing means comprises a plurality of circumferentially-spaced disc biasing tabs.

5. The spring washer of claim 4 wherein said disc biasing tabs have a circumferential width that is substantially greater than the circumferential width of said locating tabs.

6. The spring washer of claim 1 wherein said spring washer includes a flat ring-like base portion having inner and outer peripheries, said locating means comprising a plurality of circumferentially-spaced locating tabs extending outwardly from said outer periphery, each said locating tab having a first tab portion lying substantially in the plane of said base portion and a second tab portion extending substantially perpendicular to said first tab portion.

7. The spring washer of claim 6 wherein said disc biasing means comprises a plurality of circumferentially-spaced disc biasing tabs extending outwardly from said outer periphery of said base portion and being inclined out of the plane of said base portion at angles less than 30°.

8. The spring washer of claim 7 wherein said locating tabs have locating tab terminal ends and said disc biasing tabs have disc biasing tab terminal ends, said locating tab terminal ends being spaced from said base portion a substantially greater distance than said disc biasing tab terminal ends.

9. The spring washer of claim 1 including opposed biasing means on the same side of said spring washer as said attaching means for biasing against a switch case.

10. In a thermostat including a housing having an internal disc receiving recess surrounded by a shoulder, a bimetal disc spacing said recess and having an outer peripheral surface portion engaging said housing adjacent said shoulder, a switch case in said housing, disc biasing means positioned between said bimetal disc and said switch case for biasing said peripheral surface portion of said disc into firm engagement with said housing shoulder, said biasing means acting on said disc only closely adjacent its outer periphery, attaching means on said disc biasing means for attaching said disc biasing means to said switch case and for locating same in a predetermined position relative to said switch case during assembly of said housing to said switch case, and locating means on said disc biasing means cooperable with said bimetal disc for locating and maintaining said disc biasing means and bimetal disc in predetermined relationship to one another during assembly of same into said housing.

11. A spring washer for assembly between a switch case and a bimetal disc in a thermostat to bias the disc in a direction away from the switch case , said spring washer including a base portion having resilient attaching means extending outwardly therefrom for attaching same to a switch case and for locating same in a predetermined position relative to a switch case during assembly of such case with a disc housing, and biasing means extending in opposite directions from said base portion of said spring washer for respectively engaging an end surface on a switch case and a surface of a bimetal disc to bias the disc away from the switch case.

12. In a thermostat including a housing having an internal disc receiving recess surrounded by a shoulder, a bimetal disc spanning said recess and having an outer peripheral surface portion engaging said housing adjacent said shoulder, a switch case in said housing, a switch in said switch case having a movable arm, a reciprocating transfer pin between said disc and arm for transferring movement of said disc to said arm, said transfer pin having one end portion engaging said disc and having an opposite end portion engaging said arm, said opposite end portion of said transfer pin having a shoulder thereon spaced toward said disc from said arm, and a leaf spring engaging said shoulder on one side of said arm and engaging said switch case on the opposite side of said arm for biasing said pin into firm engagement with said disc.

13. In a thermostat including a housing having an internal disc receiving recess surrounded by a shoulder, a bimetal disc spanning said recess and having an outer peripheral surface portion engaging said housing adjacent said shoulder, a switch case in said housing, disc biasing means positioned between said bimetal disc and said switch case and including a plurality of circumferentially spaced disc biasing tabs acting on said disc only closely adjacent its outer periphery for biasing said peripheral surface portion of said disc into firm engagement with said housing shoulder, and locating means on said disc biasing means cooperable with said bimetal disc for locating said maintaining said disc biasing means and bimetal disc in predetermined relationship to one another during assembly of same into said housing.

14. In a thermostat including a housing having an internal disc receiving recess surrounded by a shoulder, a bimetal disc spanning said recess and having an outer peripheral surface portion engaging said housing adjacent said shoulder, a switch case in said housing, disc biasing means positioned between said bimetal disc and said switch case for biasing said peripheral surface portion of said disc into firm engagement with said housing shoulder, said biasing means acting on said disc only closely adjacent its outer periphery, and opposed biasing means on said disc biasing means for biasing against said switch case in opposition to said disc biasing means.

15. In a thermostat including a housing having an internal disc receiving recess surrounded by a shoulder, a bimetal disc spanning said recess and having an outer peripheral surface portion engaging said housing adjacent said shoulder, a switch case in said housing, disc housing means positioned between said bimetal disc and said switch case for biasing said peripheral surface portion of said disc into firm engagement with said housing shoulder, said biasing means acting on said disc only closely adjacent its outer periphery, and said disc biasing means including resilient attaching means for attaching same to said switch case.

16. In a thermostat including a housing having an internal disc receiving recess surrounded by a shoulder, a bimetal disc spanning said recess and having an outer peripheral surface portion engaging said housing adjacent said shoulder, a switch case in said housing, a spring washer having disc biasing means thereon and being positioned between said bimetal disc and said switch case for biasing said peripheral surface portion of said disc into firm engagement with said housing shoulder, said biasing means acting on said disc only closely adjacent its outer periphery, said spring washer including a flat ring-like base portion having inner and outer peripheries, and said disc biasing means extending outwardly from said outer periphery of said base portion.

17. The thermostat of claim 16 wherein said disc biasing means comprises a plurality of disc biasing tabs spaced around said outer periphery, each said disc biasing tab being bent out of the plane of said base portion toward said bimetal disc at an angle less than 30 °.

* * * * *